US008096684B2

(12) United States Patent
Salm et al.

(10) Patent No.: US 8,096,684 B2
(45) Date of Patent: Jan. 17, 2012

(54) DEVICE FOR INFLUENCING A LIGHT BEAM IN PARTICULAR FOR STAGE ILLUMINATION

(75) Inventors: Markus Salm, Heusweiler (DE); Udo Kuenzler, Karlsbad (DE)

(73) Assignee: GLP German Light Products GmbH, Karlsbad (DE)

( * ) Notice: Subject to any disclaimer, the term of this patent is extended or adjusted under 35 U.S.C. 154(b) by 106 days.

(21) Appl. No.: 12/298,350

(22) PCT Filed: Mar. 28, 2007

(86) PCT No.: PCT/EP2007/002768
§ 371 (c)(1),
(2), (4) Date: Feb. 25, 2009

(87) PCT Pub. No.: WO2007/124822
PCT Pub. Date: Nov. 8, 2007

(65) Prior Publication Data

US 2009/0154165 A1 Jun. 18, 2009

(30) Foreign Application Priority Data

Apr. 28, 2006 (DE) ..... 20 2006 007 047 U

(51) Int. Cl.
*F21V 21/26* (2006.01)

(52) U.S. Cl. ..... 362/272; 362/286; 362/386; 362/428

(58) Field of Classification Search ..... 362/265, 362/272, 286, 386, 284, 428
See application file for complete search history.

(56) References Cited

U.S. PATENT DOCUMENTS

| | | | | |
|---|---|---|---|---|
| 6,241,366 | B1 * | 6/2001 | Roman et al. | 362/293 |
| 6,866,402 | B2 * | 3/2005 | Belliveau | 362/272 |
| 7,364,324 | B2 * | 4/2008 | De Sisti | 362/265 |
| 2003/0117802 | A1 | 6/2003 | Sisti | |

FOREIGN PATENT DOCUMENTS

FR 2838178 A1 10/2003

* cited by examiner

*Primary Examiner* — Stephen F Husar
(74) *Attorney, Agent, or Firm* — Glenn Patent Group; Michael A. Glenn

(57) ABSTRACT

The device for influencing a light beam includes a primitive element and a housing which is arranged at a rotatable arm and which is rotatable with respect to the primitive element by means of one of the several drive units, and into which a light source for generating a light beam may be introduced, wherein at least one control electronics for operating the device is arranged in the rotatable arm or in the housing.

12 Claims, 3 Drawing Sheets

DEVICE FOR INFLUENCING A LIGHT BEAM IN PARTICULAR FOR STAGE ILLUMINATION

CROSS-REFERENCE TO RELATED APPLICATIONS

This application is a national phase 371 entry of PCT/EP2007/002768 filed 28 Mar. 2007, which claims priority to German Patent Application No. 202006007047.8 filed 28 Apr. 2006.

BACKGROUND OF THE INVENTION

The invention relates to a device for influencing a light beam, in particular a light beam for stage, entertainment or spot illumination.

Such devices are, for example, known as so-called moving heads and are basically arranged as illustrated in FIG. 3. An arm is rotatably mounted to a primitive element, to which in turn a housing is mounted, in which a light source is housed. From several drives, usually two drives, a rotation of the rotatable arm and the housing results. The two axes of rotation around which those movements take place are arranged in a right angle to each other. In the housing itself means may be provided by which the light beam of the light source housed in the housing is influenced, e.g. with regard to its color, as it is obvious for a person skilled in the art.

Hitherto, the complete control electronics and, in particular, also the electronic ballast required, have been arranged in the primitive element, in particular, with Halogen, discharge or LED lamps. This has the advantage that the masses to be moved, in particular of the rotatable arm, may be kept low, which is an advantage also with the comparatively high speeds resulting from low inertial force. However, the primitive element thus also takes up a correspondingly large space.

Similar devices are, for example, known from the U.S. Pat. No. 4,931,916, wherein a light beam may be redirected into different directions by means of rotatorily driven mirrors. As in the solution illustrated in FIG. 3, a rotation takes place around two angularly arranged axes in order to thus be able to cover the complete space, if possible. Also here usually the electronics are arranged in the primitive element.

SUMMARY

According to the embodiment, the device for influencing a light beam may have a primitive element; a housing, which is arranged at an arm rotatable with respect to the primitive element so as to be rotatable by means of a drive unit, and into which a light source may be introduced for generating the light beam, wherein at least one control electronics is arranged in the rotatable arm for operating the device.

At least the basic parts of the control electronics are housed in the arm or head and at least one of the drives is housed in the rotatable arm, which leads to a substantial decrease of the size of the primitive element. This does not only lead to a better appearance but, in particular, also has advantages regarding the placement in stage settings. On the one hand, due to the smaller primitive element a better mounting to the crossbars is possible which are usually provided for mounting illumination elements. In particular, however, the primitive element covers existing sets as little as possible, so that the device may be used without problems and in many ways. Thus, it is not needed any more to hide the primitive element in sets by coloring the same using a corresponding set color which varies from set to set. Constant expensive changes of the color of the primitive elements are thus prevented.

Also the electronic ballast is housed in the rotatable arm or in the head and/or not in the primitive element. All in all, the load on the rotational axis is thus higher as a consequence of the higher mass of the rotatable arm, on the other hand a compact, stable basis results which enables a simpler arrangement. As required, the ballast may also consist of several parts in order to be able to house the same in the rotatable arm. It is advantageous in particular in this case to evenly distribute the additional weight to the arm. If the ballast and/or the weight shifted into the arm, for example, comprises two parts, one part of the ballast is put into the left arm and the other part is put into the right arm, so that the center of gravity of the arm changes less than if the complete weight was shifted into only one part.

Further advantages result from the sub-claims and the following description.

BRIEF DESCRIPTION OF THE DRAWINGS

In the following, the invention is explained in more detail with reference to an embodiment illustrated in the Figures, in which.

DETAILED DESCRIPTION OF THE INVENTION

Before the invention is described in more detail, it is to be noted, that it is not limited to the respective components of the device and/or the respective method steps, as these components and methods may vary. The terms used here are only designated to describe special embodiments and are not to be used in a limiting sense. When, in addition to that, in the description or in the claims singular forms or indefinite articles are used, the same also refer to the plural forms of those elements, as far as the context does not clearly indicate otherwise.

Figure 2:
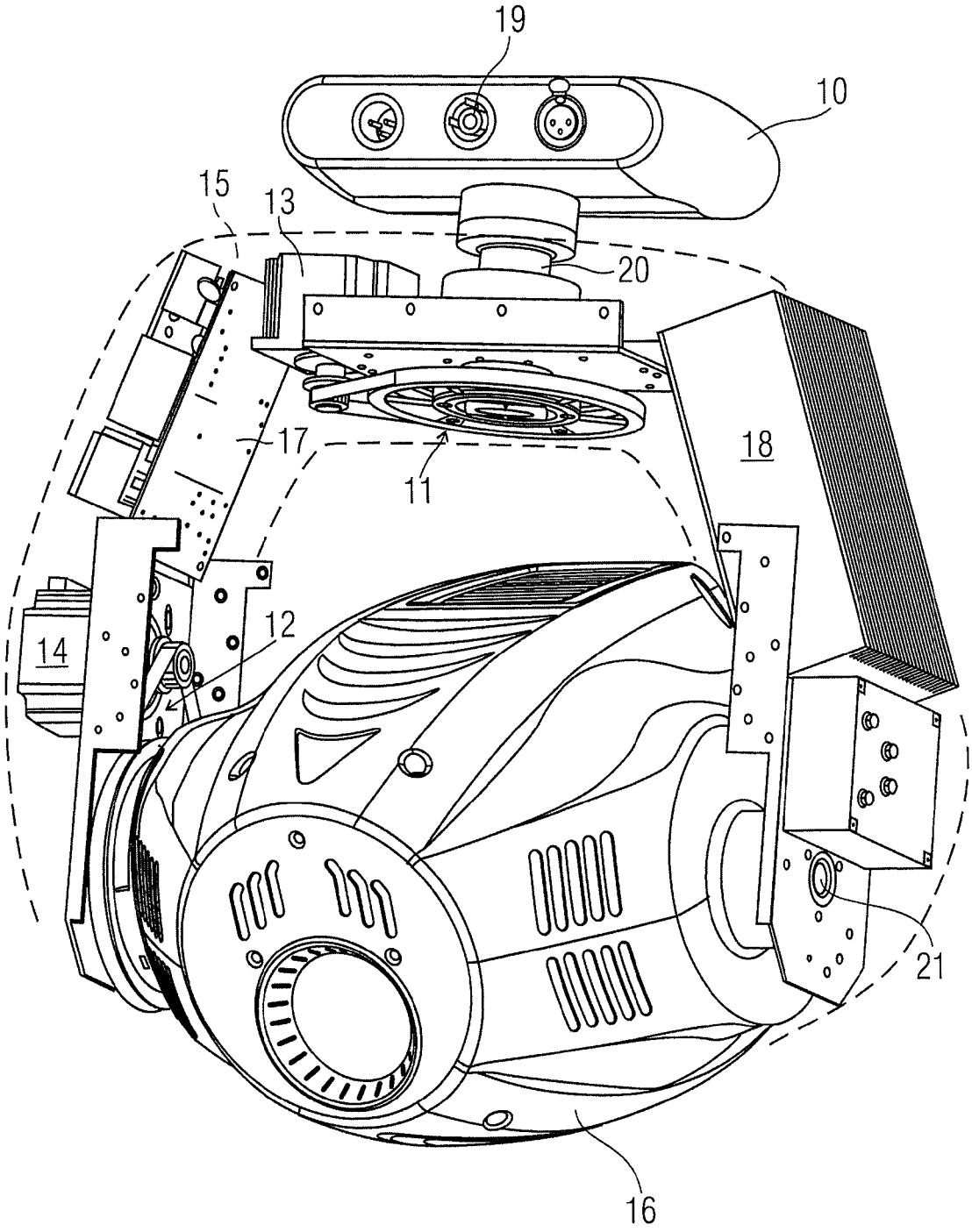
FIG. 2 shows a illustration according to FIG. 1 with the cover of the handle removed.
Figure 3:
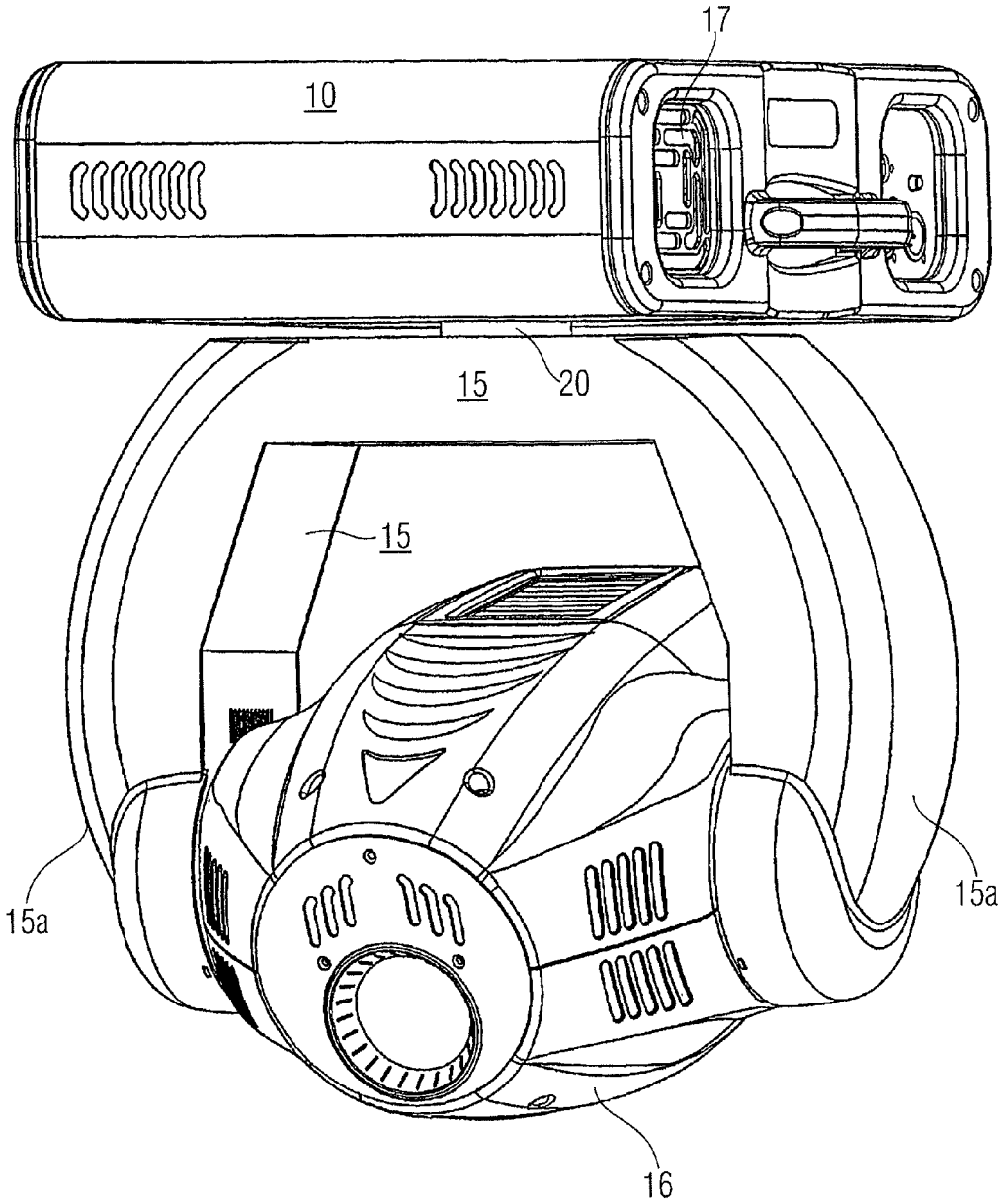
FIGURE 3 (PRIOR ART)
FIG. 3 shows a view of the device according to the prior art.

The invention is based on an implementation according to the prior art, as it is illustrated in FIG. 3. In this implementation, a comparatively large primitive element is provided, via which usually the mounting to a crossbar is performed. This device, just like the inventive device according to FIGS. 1 and 2, serves for influencing a light beam, i.e., for example influencing a light beam for stage, entertainment and spot illumination.

The device may be implemented as a lamp which may, however, also be used for other purposes, in which a movable light source is required.

Via a rotary and/or pivot bearing 20, a rotatable arm 15 is rotatably mounted to the primitive element 10. In this arm, a housing 16 for a light source is arranged, wherein this housing is again rotatably mounted around a rotational axis 21 with regard to the arm. The rotation of the rotatable arm 15 and the housing 16 respectively takes place by actuating drive units, which are not illustrated in FIG. 3. In the housing 16 a light source is located, which is not illustrated in the drawing, whose light beam may be changed by means for influencing the same.

Depending on the purpose of use, e.g., color, azimuth and height of the light beam may be changed, wherein in the head and/or the housing 16, the means for influencing the color, the projection pattern, the focusing, the angle of radiation or the luminance or lightness, respectively, are arranged, while in the arm the motors for controlling the head and thus the light beam in two orthogonal directions, e.g., PAN or TILT or azimuth and height are arranged. The alignment of the light beam takes place by actuating the rotation drives, wherein usually the rotational axis for the rotatable arm 15 and the rotational axis 21 for the housing 16 are in a right angle to each other to possibly be able to reach the complete area. The boundary of this area is limited by the outline of the primitive element in the direction towards the primitive element. It is to be noted, that the useable rotational angle around the rotational axis 21 becomes the larger the smaller the primitive element becomes. The smaller in particular the surface of the primitive element facing the head, the less the primitive element will shade the light beam when the head is rotated upwards in FIG. 2.

Figure 1:
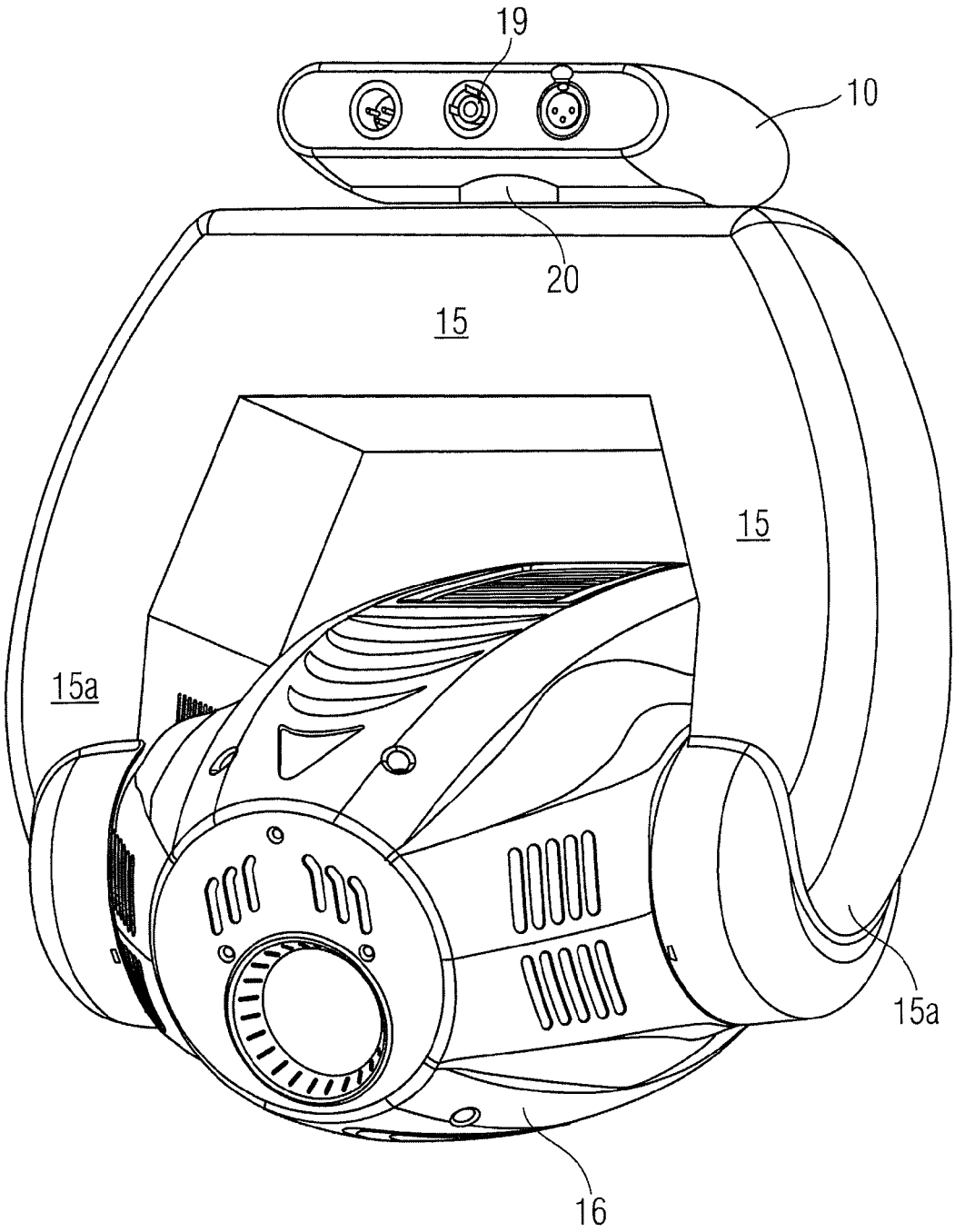
FIG. 1 shows a three dimensional view of the device.

If this embodiment according to the prior art according to FIG. 3 is compared to the inventive embodiment according to FIG. 1, it first of all becomes clear that the primitive element 10 is clearly more compact. The reason for this is, that within the primitive element 10, basically only few connector or terminal elements, respectively, are present, e.g., to the power supply network via the mains supply 19 or for control signals. Apart from that, the primitive element only has to serve as a mounting plate to mount the device, e.g., to a crossbar.

When comparing FIGS. 1 and 3, it further becomes clear that the rotatable arm 50 is more voluminous. The reason for this is, that within the rotatable arm 15, the control electronics 17 for operating the device and at least one drive unit 11 for rotating the rotatable arm 15 are arranged. Within the rotatable arm 15 according to FIG. 2 the complete movement mechanics and control electronics are arranged. Thus, in FIG. 2, in the right part of the handle-like rotatable arm 15 an electronic ballast 18 is located, as it is in particular required when the light source is a halogen lamp, a discharge lamp or one or several LEDs. In order to be able to house this ballast within the rotatable arm, which is only indicated in dashed lines in FIG. 2, this ballast 18 may also consist of several parts. All in all, from this setup a compact look results, as the slight reinforcement of the rotatable arm 15 is hardly obvious, as simultaneously the effort is made to keep the assembly room as small as possible. Due to the compact primitive element 10 also mounting to a crossbar is facilitated, at the same time sets are covered as little as possible and the primitive element obstructs the propagation of the light beam less than the larger primitive element according to the prior art.

It is to be noted that electronics and ballast may alternatively also be accommodated partially or completely within the head.

FIG. 2 shows, that in the top part of the rotatable arm driven by the motor 13, the first drive unit 11 is provided by means of which the rotatable arm 15 is rotatable via the bearing 20 with regard to the primitive element 10. In the left part, the motor 14 with the drive unit 12 is located for the rotation of housing 16 around the rotational axis 21 with regard to the rotatable arm 15. Here, the dimensions of the handle-like rotatable arm are selected so that the housing 16 may rotate by 360° around the rotational axis 21, if required. The rotational axis 21 is further located at ends 15*a* of the rotatable arm 15 remote from the primitive element 10. At the primitive element 10, only the most important terminals are provided, so that basically only energy and data lines for the control signals have to be led through the bearing 20 to the control electronics 17 in order to operate the device. The primitive element 10 contains the mains supply 19 and/or a data terminal for providing data for controlling the device and/or assembly means for mounting the device to a carrier. Drive motors, all electronic parts for controlling the drive motors and for otherwise influencing the light beam etc., are, however, not arranged in the primitive element but in the arm or in the head and/or housing.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

The invention claimed is:

1. A device for influencing a light beam, comprising:

a basis element;

a rotatable arm rotatable with respect to the basis element;

a drive unit configured for rotating the rotatable arm with respect to the basis element;

a housing being arranged at the arm and being configured for receiving a light source for generating the light beam; and at least one control electronics for operating the device, wherein the at least one control electronics for operating the device and the drive unit for rotating the rotatable arm are arranged within the rotatable arm, and wherein the basis element contains a mains supply and a data terminal and assembly means for mounting the device to a carrier.

2. The device according to claim 1, wherein the control electronics arranged in the rotatable arm comprises an electronic ballast for the light source for generating the light beam.

3. The device according to claim 2, wherein the electronic ballast comprises several parts.

4. The device according to claim 1, wherein two drive units are present and both drive units for the rotation of the rotatable arm and also for the rotation of the housing are arranged in the rotatable arm.

5. The device according to claim 1, wherein the rotatable arm is handle-like and comprises a rotational axis for the rotation of the housing at its ends (15*a*) remote from the basis element.

6. The device according to claim 1, wherein the light source comprises a halogen lamp, an LED, a laser or a discharge lamp.

7. The device according to claim 1, wherein in the basis element the mains supply and/or a data terminal for providing data for controlling the device and/or mounting units for mounting the device to a carrier are provided.

8. The device according to claim 1, wherein at least one drive unit for the rotation of the rotatable arm with regard to the basis element is arranged in the rotatable arm.

9. The device according to claim 1, wherein influencers for influencing the light source are attached in the rotatable arm or the housing but are not attached in the basis element.

10. The device according to claim 1, wherein influencers for influencing comprise influencers for influencing the color, the projection pattern, the focusing, the angle of radiation or the luminance of the light beam, which are housed in the housing, and wherein influencers for influencing comprise motors for controlling the housing in two orthogonal directions, which are arranged in the rotatable arm.

11. The device according to claim 1, wherein all influencers for influencing the light beam are arranged in the rotatable arm with respect to the direction of the light beam.

12. The device according to claim 2, wherein the rotatable arm comprises a left part and a right part, wherein the electronic ballast comprises two parts, and wherein a first part of the electronic ballast is seated into the right part of the rotatable arm, and wherein a second part of the electronic ballast is seated into the left part of the rotatable arm.

* * * * *